US010856573B2

(12) United States Patent
Pijnenburg et al.

(10) Patent No.: US 10,856,573 B2
(45) Date of Patent: Dec. 8, 2020

(54) TOBACCO SACHET FOR USE IN A TOBACCO VAPORIZER

(71) Applicant: Philip Morris Products S.A., Neuchatel (CH)

(72) Inventors: Johannes Petrus Maria Pijnenburg, Neuchatel (CH); Dionisius Elisabeth Antonius Florack, Le Landeron (CH); Noori Moyad Brifcani, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 453 days.

(21) Appl. No.: 15/525,297

(22) PCT Filed: Dec. 15, 2015

(86) PCT No.: PCT/EP2015/079900
§ 371 (c)(1),
(2) Date: May 9, 2017

(87) PCT Pub. No.: WO2016/096927
PCT Pub. Date: Jun. 23, 2016

(65) Prior Publication Data

US 2017/0360088 A1 Dec. 21, 2017

(30) Foreign Application Priority Data

Dec. 16, 2014 (EP) ..... 14198383

(51) Int. Cl.
*A24F 47/00* (2020.01)

(52) U.S. Cl.
CPC ..... *A24F 47/004* (2013.01)

(58) Field of Classification Search
None
See application file for complete search history.

(56) References Cited

U.S. PATENT DOCUMENTS 3,860,012 A 1/1975 Selke
3,894,544 A 7/1975 Egri
(Continued)

FOREIGN PATENT DOCUMENTS

CN 102762118 A 10/2012
CN 103987286 A 8/2014
(Continued)

OTHER PUBLICATIONS

International Search Report and Written Opinion dated Apr. 18, 2016 in PCT/EP2015/079900, filed Dec. 15, 2015.
(Continued)

*Primary Examiner* — Eric Yaary
(74) *Attorney, Agent, or Firm* — Oblon, McClelland, Maier & Neustadt, L.L.P.

(57) ABSTRACT

A sachet of aerosol-forming substrate for electrically heated aerosol-generating device is provided, including a porous container; and an aerosol-forming substrate within the container, the substrate having a porosity of between about 0.2 and about 0.35, the porosity being the volume fraction of void space within the container. An electrically heated aerosol-generating system is also provided, including a sachet of aerosol-forming substrate; and an aerosol-generating device, the device including an outer housing having a cavity configured to receive the sachet, and an electrical heater including at least one heating element configured to heat the sachet in the cavity to generate an aerosol from the aerosol-forming substrate for inhalation by a user.

15 Claims, 3 Drawing Sheets

(56) References Cited

U.S. PATENT DOCUMENTS

| | | | | |
|---|---|---|---|---|
| 4,981,522 | A | 1/1991 | Nichols et al. | |
| 5,080,114 | A | 1/1992 | Rudolph et al. | |
| 5,388,594 | A | 2/1995 | Counts et al. | |
| 5,498,855 | A | 3/1996 | Deevi et al. | |
| 5,514,630 | A | 5/1996 | Willkens et al. | |
| 5,724,998 | A | 3/1998 | Gellatly et al. | |
| 2007/0261707 | A1* | 11/2007 | Winterson | A24B 13/00 131/352 |
| 2009/0293888 | A1 | 12/2009 | Williams et al. | |
| 2011/0303232 | A1* | 12/2011 | Williams | B65D 31/02 131/359 |
| 2012/0067362 | A1* | 3/2012 | Mola | A24B 13/00 131/359 |
| 2012/0247494 | A1 | 10/2012 | Oglesby et al. | |
| 2016/0106143 | A1* | 4/2016 | Mei | A24B 15/14 131/374 |
| 2016/0205993 | A1* | 7/2016 | Borjesson | A24B 13/00 |

FOREIGN PATENT DOCUMENTS

| | | | |
|---|---|---|---|
| DE | 10 2005 054255 | A1 | 5/2007 |
| GB | 983928 | A | 2/1965 |
| JP | 2017-524368 | A | 8/2017 |
| WO | WO 03/095688 | A2 | 11/2003 |
| WO | WO 2010/073122 | A1 | 7/2010 |
| WO | WO 2011/101164 | A1 | 8/2011 |
| WO | 2014/125049 | A1 | 8/2014 |
| WO | WO 2015/055567 | A1 | 4/2015 |
| WO | WO 2015/082560 | A1 | 6/2015 |

OTHER PUBLICATIONS

Japanese Office Action dated Jan. 27, 2020, in Patent Application No. 2017-531548, citing document AO therein, 5 pages (with English translation).

Combined Chinese Office Action and Search Report dated Sep. 17, 2019, in Patent Application No. 201580064399.2, citing documents AO-AP therein, 17 pages (with English translation).

Office Action and Search Report dated Jun. 28, 2020 in Chinese Patent Application No. 201580064399.2, along with an English translation.

* cited by examiner

TOBACCO SACHET FOR USE IN A TOBACCO VAPORIZER

The present invention relates to a sachet of aerosol-forming substrate for use in an electrically heated aerosol-generating device. The invention further relates to an electrically heated aerosol-generating system for use with the sachet.

Electrically heated smoking systems typically include a power supply, such as a battery, connected to a heater to heat an aerosol-forming substrate, to form the aerosol which is provided to the smoker. In operation, these electrically heated smoking systems typically provide a high power pulse to the heater to provide the temperature range desired for operation and to release the volatile compounds. Electrically heated smoking systems may be reusable and may be arranged to receive a disposable smoking article containing the aerosol-forming substrate to form the aerosol. Alternatively, loose tobacco may be provided adjacent the electrical heater. Where loose tobacco is used, typically the user fills a cavity with the required amount of tobacco before using the device. The loose tobacco is then heated to a temperature sufficient to volatilise the desirable volatile compounds in the tobacco without reaching a temperature sufficient for combustion of the tobacco.

Such systems produce highly varied results depending on many factors only in the control of the user, such as the specific properties, and type, of the tobacco used, the quantity of tobacco placed in the cavity, and how much the user compresses the tobacco when providing it in the cavity.

Therefore, it would be desirable to reduce the variability, and increase the quality, of the aerosol generated by such devices.

According to a first aspect of the present invention, there is provided a sachet of aerosol-forming substrate for use in an electrically heated aerosol-generating device. The sachet comprises: a porous container; and an aerosol-forming substrate. The aerosol-forming substrate within the container has a porosity of between about 0.2 and about 0.35, the porosity being the volume fraction of void space within the container. In a preferred embodiment, the porosity is between about 0.24 and about 0.35.

Firstly, providing the aerosol-generating substrate in sachet form enables a consistent quantity of substrate for each use, without need for any skill by the user.

Secondly, providing substrate in sachet form enables the porosity of the aerosol-forming substrate within the sachet to be controlled such that a substantially optimum porosity is provided for each use, which improves the consistency of aerosol generation. The porosity of the tobacco is important because when the density is too low the substrate is more prone to combustion, and when it is too high, the temperature difference between the substrate at the edge of the sachet and the substrate at the centre is too high. The specific range of porosity provided by the present invention allows these advantages to be put into effect, and more specifically provides the user with a more consistent resistance-to-draw than for loose tobacco used in aerosol-generating devices the sachet according to the present invention may be used in.

Furthermore, the porosity being within the ranges described above improves the aerosol generation and provides a suitable resistance-to-draw. The overall resistance-to-draw of the sachet when in an aerosol-generating device is preferably between about 40 $mmH_2O$ and about 120 $mmH_2O$.

As used herein, the term 'aerosol-forming substrate' is used to describe a substrate capable of releasing upon heating volatile compounds, which can form an aerosol. The aerosols generated from aerosol-forming substrates according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may comprise tobacco and an aerosol-former. The tobacco may be one or more of: pipe tobacco; cut filler; reconstituted tobacco; and homogenised tobacco.

The aerosol-forming substrate preferably comprises: homogenised tobacco material; aerosol-former; and water. Providing homogenised tobacco material improves the aerosol generation, the nicotine content and the flavour profile. This is because the process of making the homogenised tobacco involves grinding tobacco leaf which enables the release of nicotine and flavours upon heating much more effectively.

The sachet is preferably formed from a mesh. The mesh is preferably porous to the generated aerosol, and enables the aerosol to be released from the sachet with causing condensation. The mesh may be formed by any suitable process, such as weaving the material, or by cutting using a toothed roller or the like, and then expanding the material by providing a force perpendicular to the axis of the toothed rollers.

The sachet may be formed from any suitable material which is capable of resisting the high temperature during use, without combusting or imparting undesirable flavours into the aerosol. In particular, the natural fibres sisal and ramie are particularly appropriate for forming the sachet. Alternatively, the sachet may be formed from ceramic fibres or metal.

The material used to form the sachet may be between about 50 microns and about 300 microns in thickness. Providing such a sachet using thin material reduces the insulating effect the sachet may provide between a heater and the tobacco material. The fibre size of the material used to form the sachet may be between about 10 microns and about 30 microns.

The sachet container may be any suitable shape and size. In some embodiments, in a first direction, the cross-sectional the shape of the container is one of: an oval; a circle; a rectangle; a square; and a triangle. The cross-sectional shape, in a second direction perpendicular to the first direction, may be one of: a rectangle; a triangle a circle; and an oval.

The homegenised tobacco material is preferably provided in sheets which are: folded; crimped; or cut into strips. In a particularly preferred embodiment, the sheets are cut into strips having a width of between about 0.2 mm and about 2 mm, more preferably between about 0.4 mm and about 1.2 mm. In one embodiment, the width of the strips is about 0.9 mm.

Alternatively, the homogenised tobacco material may be formed into spheres, using spheronization. The mean diameter of the spheres is preferably between about 0.5 mm and about 4 mm, more preferably between about 0.8 mm and about 3 mm.

The aerosol-forming substrate preferably comprises: homogenised tobacco material between about 55% and about 75% by weight; aerosol-former between about 15% and about 25% by weight; and water between about 10% and about 20% by weight.

Before measuring the samples of aerosol-forming substrate they are equilibrated for 48 hours at 50% relative humidity at 22 degrees C. The Karl Fischer technique is used to determine the water content of the homogenised tobacco material.

The aerosol-forming substrate may further comprise a flavourant between about 0.1% and about 10% by weight. The flavourant may be any suitable flavourant known in the art, such as menthol.

Sheets of homogenised tobacco material for use in the invention may be formed by agglomerating particulate tobacco obtained by grinding or otherwise comminuting one or both of tobacco leaf lamina and tobacco leaf stems.

Sheets of homogenised tobacco material for use in the invention may comprise one or more intrinsic binders that is a tobacco endogenous binder, one or more extrinsic binders that is a tobacco exogenous binder, or a combination thereof to help agglomerate the particulate tobacco. Alternatively, or in addition, sheets of homogenised tobacco material for use in the invention may comprise other additives including, but not limited to, tobacco and non-tobacco fibres, flavourants, fillers, aqueous and non-aqueous solvents and combinations thereof.

Suitable extrinsic binders for inclusion in sheets of homogenised tobacco material for use in the invention are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and 30 pectins; and combinations thereof.

A number of reconstitution processes for producing sheets of homogenised tobacco materials are known in the art. These include, but are not limited to: paper-making processes of the type described in, for example, U.S. Pat. No. 3,860,012; casting or 'cast leaf' processes of the type described in, for example, U.S. Pat. No. 5,724,998; dough reconstitution processes of the type described in, for example, U.S. Pat. No. 3,894,544; and extrusion processes of the type described in, for example, in GB-A-983,928. Typically, the densities of sheets of homogenised tobacco material produced by extrusion processes and dough reconstitution processes are greater than the densities of sheets of homogenised tobacco materials produced by casting processes.

Sheets of homogenised tobacco material for use in the invention are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The homogenised tobacco sheet material may be produced using different types of tobacco. For example, tobacco sheet material may be formed using tobaccos from a number of different varieties of tobacco, or tobacco from different regions of the tobacco plant, such as leaves or stem. After processing, the sheet has consistent properties and a homogenised flavour. A single sheet of homogenised tobacco material may be produced to have a specific flavour. To produce a product having a different flavour, a different tobacco sheet material needs to be produced. Some flavours that are produced by blending a large number of different shredded tobaccos in a conventional cigarette may be difficult to replicate in a single homogenised tobacco sheet. For example, Virginia tobaccos and Burley tobaccos may need to be processed in different ways to optimise their individual flavours. It may not be possible to replicate a particular blend of Virginia and Burley tobaccos in a single sheet of homogenised tobacco material. As such, the sachet may comprise a first homogenised tobacco material and a second homogenised tobacco material. By combining two different sheets of tobacco material in a single sachet, new blends may be created that could not be produced by a single sheet of homogenised tobacco.

The aerosol-former preferably comprises at least one polyhydric alcohol. In a preferred embodiment, the aerosol-former comprises at least one of: triethylene glycol; 1,3-butanediol; propylene glycol; and glycerine.

According to a further aspect of the present invention, there is provided an electrically heated aerosol-generating system. The system comprises: a sachet of aerosol-forming substrate as described herein; and an aerosol-generating device. The aerosol-generating device comprises: an outer housing having a cavity for receiving the sachet; and an electrical heater comprising at least one heating element for heating the sachet in the cavity to generate an aerosol.

As used herein, the term 'aerosol-generating device' is used to describe a device that interacts with an aerosol-forming substrate of the sachet to generate an aerosol that is directly inhalable into a user's lungs thorough the user's mouth.

Preferably, the electrical heater is provided adjacent at least one wall, preferably a side wall of the cavity. The electrical heater may be provided substantially entirely around the periphery of the cavity. In addition, or alternatively, the electrical heater may be provided on the bottom wall of the cavity. The bottom wall being the wall opposite the open end of the cavity for receiving the sachet. The electrical heater is preferably a non-intrusive heater which does not pierce the sachet.

The electrical heater may comprise one or more heating elements. For example, the electrical heater may comprise, two, three, four, five, six, seven, eight or more heating elements.

The electrical heater is preferably a foil heater. The electrical heater may be a thin-film heater, such as a polyimide heater. The electrical heater is preferably bonded to the external wall, or walls, of the cavity.

The one or more heating elements preferably comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Examples of suitable composite heating elements are disclosed in U.S. Pat. No. 5,498,855, WO-A-03/095688 and U.S. Pat. No. 5,514,630.

As described above, the sachet may be any suitable shape, but in particular the shape of the sachet is configured to substantially match the shape of the cavity to optimise the heat transfer between the heater and the tobacco material.

The electrically heated aerosol-generating system preferably further comprises a power supply for supplying power to the electrical heater; electrical hardware connected to the power supply and the electrical heater; and a controller configured to control the supply of electrical power from the power supply to the electrical heater.

The controller is preferably configured to maintain an operating temperature of the electrical heater between about 180 degrees C. and about 300 degrees C. In one embodiment, the device further comprises a user input, configured to receive a user preference. In this embodiment, the controller is configured to control the temperature of the electrical heater in dependence on the user input. The controller may be configured to receive two, three, four, five or more signals from the input, each signal corresponding to a distinct user preference. In one particularly preferred embodiment, the controller is configured to receive three signals corresponding to electrical heater temperatures of about 190 degrees C., about 200 degrees C. and about 210 degrees C. The controller may be configured to control the temperature of the electrical heater at any other set of suitable temperatures.

The controller may be configured to continuously provide power to the electrical heater. Alternatively, or in addition, the device may further comprise a puff detector configured to detect when a user puffs on the device. When the user puffs on the device, the controller is configured to provide power to the electrical heater. In one embodiment, the controller is configured to heat the electrical heater to a first temperature, and then provide additional power to the electrical heater, when a puff is detected, to increase the temperature to a second temperature.

Preferably, the controller is a programmable controller, for example, a microcontroller, for controlling operation of the electrical heater. In one embodiment, the controller may be programmable by software. Alternatively, the controller may comprise application specific hardware, such as an Application-Specific Integrated-Circuit (ASIC), which may be programmable by customising the logic blocks within the hardware for a particular application. Preferably, the electrical hardware comprises a processor. Additionally, the electrical hardware may comprise memory for storing heating preferences for particular sachets, user preferences, user smoking habits or other information. Preferably, the information stored can be updated and replaced depending on the particular sachets usable with the smoking system. Also, the information may be downloaded from the smoking system.

The aerosol-generating device preferably comprises a user activated switch, for activating power to be supplied to the electrical heater.

The device preferably comprises at least one air inlet, and at least one air outlet, such that an air flow pathway is formed from the at least one air inlet to the at least one air outlet through the cavity. The bottom wall of the cavity, opposite the open side of the cavity, may be porous or may comprise an air inlet.

The aerosol-generating device may comprise a mouthpiece. In one embodiment, the mouthpiece is provided at a proximal end of the device, and the cavity is provided at a distal end. In this way, the air flow pathway length is maximised which may allow the aerosol to cool to a more appropriate temperature for inhalation by the user.

The device preferably comprises a lid for covering the cavity when the device is in use. The lid may be retained by any suitable means, such as magnets such as neodymium magnets, or a screw threads. The lid may comprise an air inlet.

The device may further comprise a detector capable of detecting the presence of the sachet in the cavity and distinguishing the sachet from other sachets configured for use with the system. The detector may be used to control power to the electrical heater, such that no power may be supplied unless a sachet is detected in the cavity. Alternatively, or in addition, the detector may be configured to provide the controller with information on the type of sachet in the cavity such that an appropriate heating protocol can be used.

The heating protocol may comprise one or more of: a maximum operating temperature for the electrical heater, a maximum heating time per puff, a minimum time between puffs, a maximum number of puffs per sachet and a maximum total heating time for the sachet. Establishing a heating protocol tailored to the particular sachet is advantageous because the aerosol-forming substrates in particular sachets may require, or provide an improved smoking experience with, particular heating conditions. As already mentioned, preferably, the electrical hardware is programmable, in which case various heating protocols may be stored and updated.

The sachet may comprise at least one of: a taggant, having an identifiable spectroscopic signature, incorporated within a material of the sachet; and identification information printed thereon. The detector is preferably configured to distinguish the sachet in dependence on the taggant or on the printed identification information.

In one embodiment, the detector preferably is a spectroscopic detector comprising an optical sensor including at least one light emitter and at least one light sensor. Preferably, the light emitter is configured to emit infra-red wavelength light, or ultraviolet wavelength light. Preferably, the light sensor is configured to detect infra-red wavelength light, or ultraviolet wavelength light.

The taggant may comprise an identifiable spectroscopic signature in absorption. When the taggant is illuminated by the light source of the aerosol-generating device, the taggant will absorb a specific wavelength, or set of wavelengths, and the wavelengths of light subsequently received by the light sensor will therefore enable the aerosol-generating device to determine the taggant in dependence on the absent wavelengths.

The physical and chemical structure of the taggant can be controlled such that the absorbed wavelength of light can be set as required. In a preferred embodiment, the absorbed wavelength of light is not in the visible spectrum. Preferably, the absorbed wavelength is in the Infra-red or Ultraviolet range.

In addition, or instead of the taggant comprising an identifiable spectroscopic signature in absorption, the taggant may comprise an identifiable spectroscopic signature in emission. When the taggant is illuminated by the light source of the aerosol-generating device, the light preferably excites the taggant and emits at least one wavelength of light, shifted from the wavelength of the excitation light. As will be appreciated, this is a form of photoluminescence, and may be phosphorescence, or fluorescence. By controlling the physical and chemical structure of the taggant the spectroscopic signature can be controlled. In some embodiments, the identifiable signature may be in dependence on the time response of the emission in relation to the excitation, or the decay rate of the emission after excitation.

In a preferred embodiment, the wavelength of the emitted light is not in the visible spectrum. Preferably, the wavelength of the emitted light is in the Infra-red or Ultraviolet range.

In another embodiment, the detector comprises an optical sensor including at least one light emitter and at least one light sensor. In this embodiment, the detector may comprise one light emitter and one light sensor. Alternatively, the detector may comprise more than one light sensor in the form of a one dimensional (e.g. linear) array of light sensors. Furthermore, the detector may comprise more than one light sensor in the form of a two dimensional array of light sensors.

The identification information printed on the smoking article may comprise one or more of: smoking article type, aerosol-forming substrate type, date of production, place of production, batch number and other production details, and use-by date.

The identification information may be printed on the article in various forms. Various inks may be used for printing, including visible ink, ultra violet (UV) ink, infra red (IR) ink, phosphorescent ink, fluorescent ink and metallic ink. In one embodiment, the identification information comprises a plurality of lines and spaces. The lines and spaces may extend substantially around the circumference of the article. The lines and spaces may have a fixed width or a variable width. The identification information may be encoded as a one dimensional barcode comprising the plurality of lines and spaces. In another embodiment, the identification information comprises a two dimensional array. The two dimensional array may comprise a data matrix or any other two dimensional barcode. The detector is configured to identify the information.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 1A:
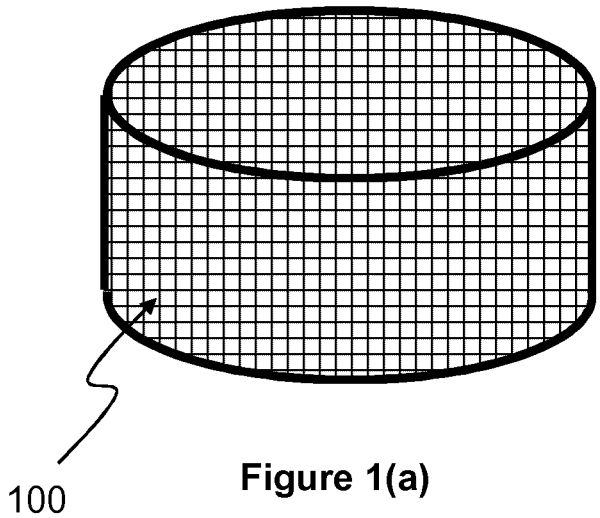
FIG. 1 show a sachet according to the present invention.
Figure 1B:
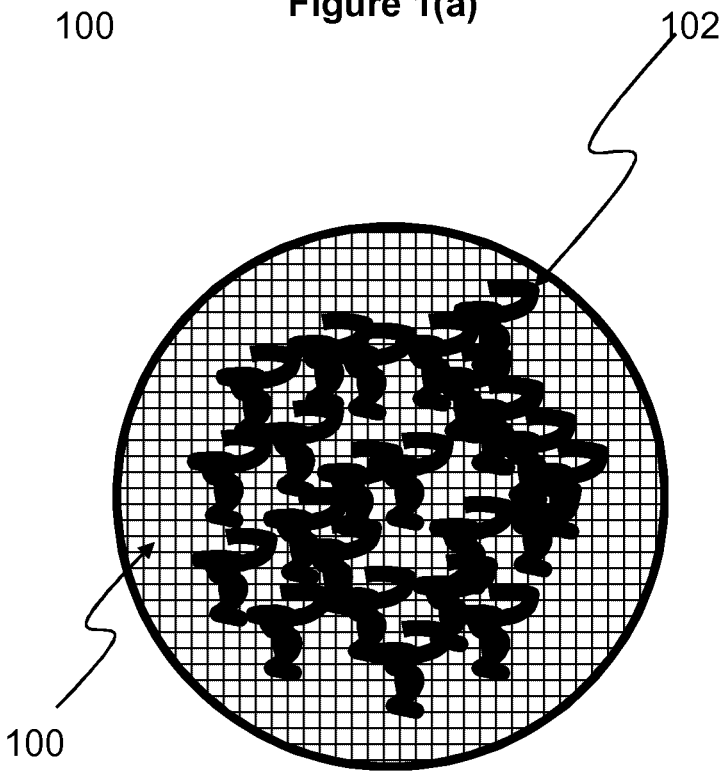

As shown in FIG. 1(*a*) the sachet 100 according to the invention comprises a container formed from a porous material for containing an aerosol-generating substrate (not shown). In this example, the sachet has a circular cross-sectional profile and is in the form of a cylinder. As shown in FIG. 1(*b*) the container comprises an aerosol-generating substrate 102. The aerosol-generating substrate comprises homogenised tobacco material between about 55% and about 75% by weight; aerosol-former between about 15% and about 25% by weight; and water between about 10% and about 20% by weight. In this particular example, the aerosol-former is glycerine between about 18.1% and about 20.9% by weight. In this example, the water content is between about 11.4% and about 12.4% by weight. The homogenised tobacco forming the remainder of the aerosol-generating substrate. In a preferred example, the aerosol-generating substrate has a porosity in the sachet of between about 24% and about 35%. The porosity can be altered in dependence on the type of tobacco, or user preference, to alter the characteristics of the generated aerosol. The porosity is defined as the volume fraction of void space within the container. Thus, a porosity of 100% would mean that the container comprised no substrate, and a porosity of 0% would mean that the container was completely full of substrate without any voids.

Before measuring the samples of aerosol-forming substrate, to determine the composition, they are equilibrated for 48 hours at 50% relative humidity at 22 degrees C. The Karl Fischer technique is used to determine the water content of the homogenised tobacco material.

The container of the sachet 100 is formed from a porous material, and may be a mesh-like material formed by either weaving or cutting and then extending. Suitable materials include the natural fibres Sisal and Ramie.

In use, the sachet is heated in an aerosol-generating device to generate an aerosol.

Figure 2A:
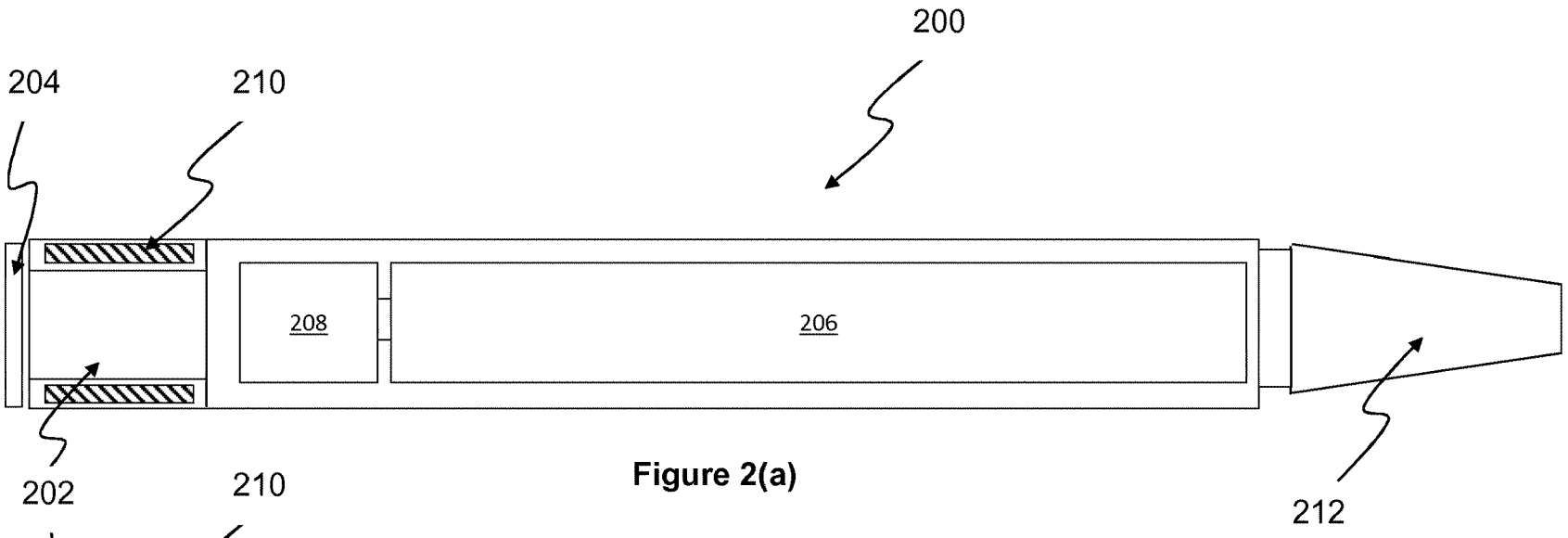
FIG. 2 show an aerosol-generating system according to the present invention.
Figure 2B:
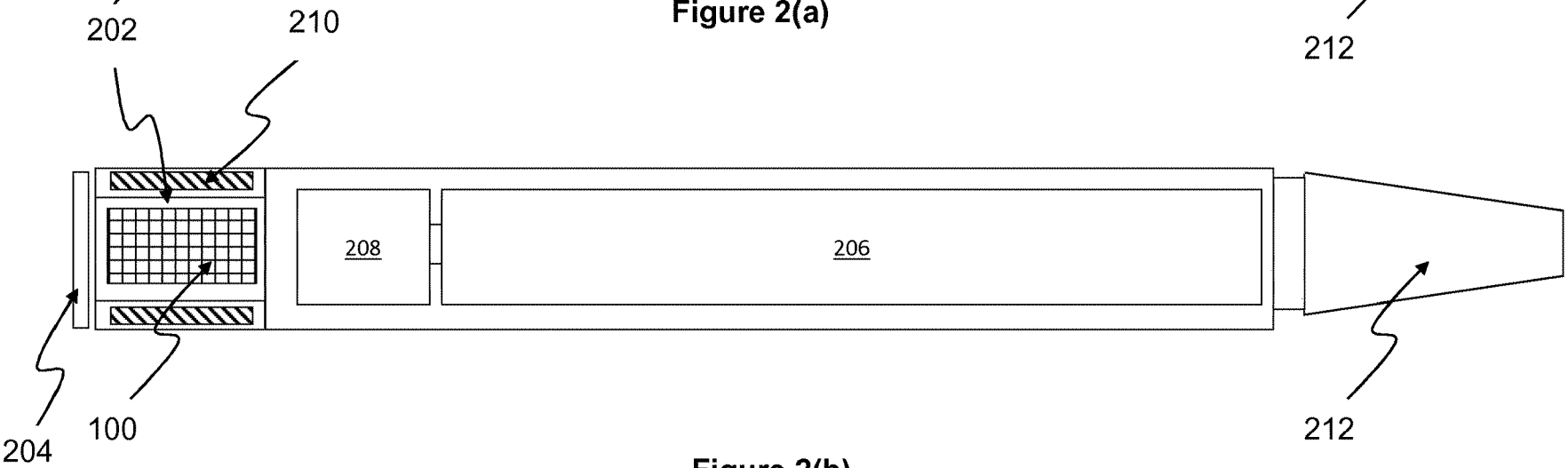

One example of an aerosol-generating device 200 used to heat the sachet to generate an aerosol is shown in FIG. 2(*a*) and FIG. 2(*b*). The device 200 comprises a cavity 202 for receiving the sachet, a lid 204 for covering the cavity 202, a power supply 206, a controller 208, an electrical heater 210 and a mouthpiece 212.

The controller 208 is configured to provide power to the electrical heater 210 from the power supply 206 to heat the sachet to the operating temperature. As can be seen, the electrical heater is provided around the periphery of the cavity to improve the heat conduction from the heater to the cavity wall and then to the sachet.

As shown in FIG. 2(*b*), the sachet 100 can be received in the cavity 202. In use, the user inserts a sachet into the cavity 202, replaces the lid 204 to close the cavity, and then activates the device. The controller then provides power to the electrical heater to increase the temperature of the sachet to the operating temperature. In a preferred embodiment, the operating temperature is about 200 degrees C.

Once the sachet reaches the operating temperature the user draws on the mouthpiece, and air is drawn through the device from an air inlet (not shown), through the cavity 202, along an airflow pathway adjacent the power supply 206 and out of an air outlet in the mouthpiece.

The mouthpiece may be removable for cleaning, or replacement as may be necessary.

In an alternative example of the sachet 100 described above, the container comprises a taggant, or has information printed thereon. The taggant is incorporated in the container material during manufacturing of the material. Where the container comprises printed information, the information may be printed before or after the material is formed into a container.

The taggant has an identifiable spectroscopic signature. The use of the taggant incorporated within the material prevents the taggant from being removed after manufacture. In this way, the tamper resistance, and difficulty of counterfeiting, of the sachet are improved.

The taggant material can be selected to control the optical properties such that it can absorb a specific wavelength of light to enable identification and/or emit light at a shifted wavelength as compared to a wavelength of light used to excite the taggant.

Figure 3:
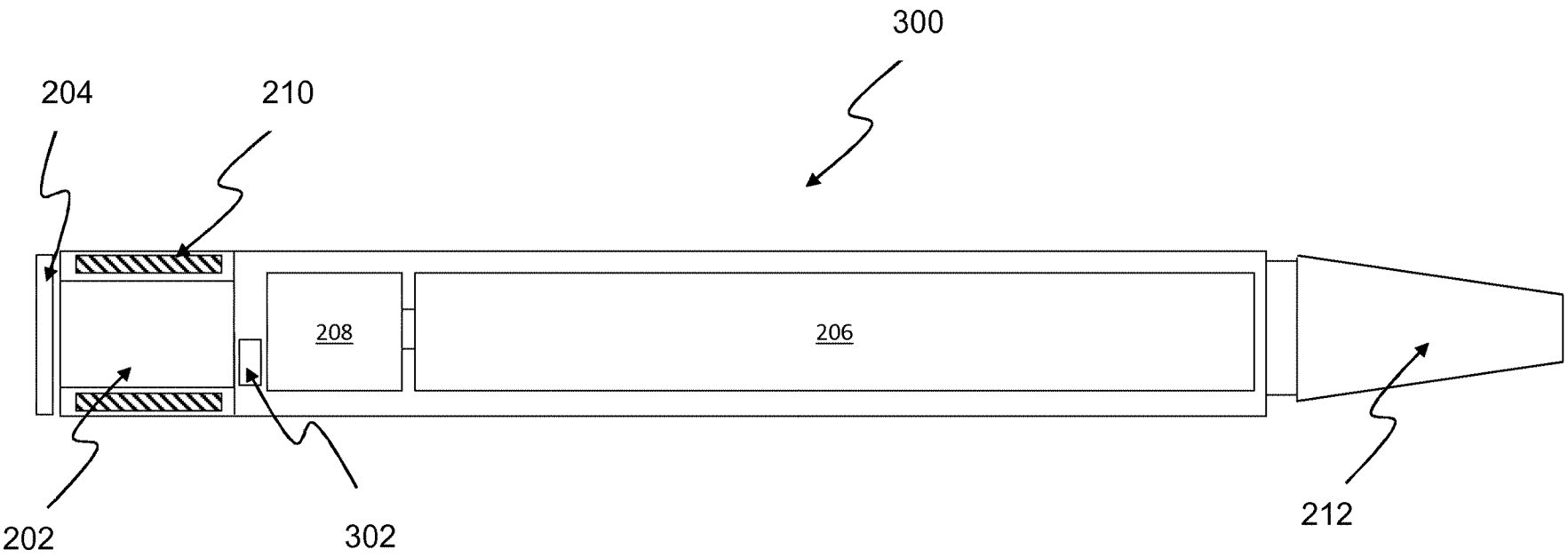
FIG. 3 shows an alternative aerosol-generating system according to the present invention.

FIG. 3 shows a perspective view of one exemplary embodiment of an electrically operated aerosol-generating system 300 according to the invention. The electrically operated aerosol-generating system 300 is a smoking system having similar components to the system 200 described above.

The electrically heated smoking system 300 further comprises a detector 302 positioned adjacent the cavity 202. The detector is able to detect the presence of a sachet in the cavity and is also able to identify the various sachets which may be usable with the system.

The detector comprises means for determining the spectroscopic signature of the taggant. The means for determining the spectroscopic signature comprises a light source and a light sensor.

In use, when the user inserts the sachet 100 into the aerosol-generating device 300 the detector 304 determines the type of sachet being inserted by emitting light, and detecting the response received by the light sensor.

When the user draws on the mouthpiece, the control circuitry, in dependence on the type of sachet 100 detected, provides power to the heater 210 to generate an aerosol. The power supplied may be optimised in accordance with the brand of aerosol-generating article, or in accordance with pre-determined user preferences, and so on. Alternatively, or in addition, if the sachet 100 is not recognised by the detector, the control circuitry may prevent power being supplied to the heater 210 to prevent the use of unauthorised aerosol-generating articles.

In a similar example to that shown in FIG. 3, the detector 302 of the aerosol-generating device 300 may be adapted to detect printed information on the sachet.

The sachet may comprise a plurality of printed lines and spaces of varying width. These may be encoded as a simple one dimensional barcode, according to appropriate barcode encoding standards (see below). Alternatively, the lines may comprise a plurality n of lines and spaces of the same width for encoding the information related to the sachet type. For example, with n=3, the following codes are possible: 000, 001, 010, 100, 011, 110, 101, 111, where 1 represents a line, and 0 represents a space. 001, 010 and 100 may not be distinguishable from each other (unless a marker line is provided to indicate to the detector where the encoding begins). Similarly, 011 and 110 may not be distinguishable from each other. Thus, five possibilities are provided with n=3. If 000 is used to indicate that no article is present, only four possibilities are provided. In general, unless a marker line is provided, $2^{n-1}+1$ possibilities are provided or, if 000 is used to indicate that no article is present, only $2^{n-1}$ possibilities are provided.

There are a number of barcode standards that might be suitable for use with the sachets of the invention. One barcode type that may be useful for the present invention is the "Interleaved 2 of 5" (I2/5) barcode, which is a high-density, continuous two-width barcode symbology. The code has bars (black lines) and spaces (white lines), each of which can be wide or narrow. I2/5 encodes a pair of digits per five bars and spaces: the first digit is encoded in the five bars, while the second digit is encoded in the five spaces interleaved with them. Two out of every five bars or spaces are wide. Alternatively, another standard barcode symbology may be used, or a custom code specifically for this application might be developed.

In this example, the detector in the electrically heated smoking system comprises a source of suitable light (IR, UV or visible, depending on the ink used on the article) and at least one photosensor that detects the reflected light. The detector may comprise a single sensor that detects the reflected light. In that case, detection of the sachet may be performed as the sachet is being inserted into the cavity, by measuring the time for the various lines to pass the detector. Or, the detector may comprise a plurality of sensors that detect the reflected light. In that case, detection of the sachet may be performed once the sachet has been inserted into the cavity. Because the lines extend around substantially the sachet's entire circumference, if a plurality of sensors are used, they only need extend in one dimension along the longitudinal axis of the sachet. Also, there is no need for the user to manually align the printed information on the sachet with the detector.

The operation of the device, once the sachet is detected, is similar to that of the device when the sachet is detected using a taggant.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. A sachet of aerosol-forming substrate for an electrically heated aerosol-generating device, the sachet comprising:

a porous container; and an aerosol-forming substrate within the container and having a porosity of between about 0.2 and about 0.35, the porosity being the volume fraction of void space within the container, wherein a material forming the porous container of the sachet has a thickness of between about 50 microns and about 300 microns, and wherein the material has a fiber size of between about 10 microns and about 30 microns.

2. The sachet according to claim 1, wherein the porosity is between about 0.24 and about 0.35.

3. The sachet according to claim 1, wherein the aerosol-forming substrate comprises tobacco and an aerosol-former.

4. The sachet according to claim 3, wherein the tobacco is at least one of: pipe tobacco, cut filler, reconstituted tobacco, and homogenised tobacco.

5. The sachet according to claim 3, wherein the tobacco is homogenised tobacco material provided in sheets, which are folded, crimped, or cut into strips.

6. The sachet according to claim 3, wherein the tobacco is homogenised tobacco material that is spheronized.

7. The sachet according to claim 3, wherein the aerosol-former comprises at least one polyhydric alcohol.

8. The sachet according to claim 7, wherein the aerosol-former further comprises at least one of: triethylene glycol, 1,3-butanediol, propylene glycol, and glycerine.

9. The sachet according to claim 1, wherein the aerosol-forming substrate comprises: homogenised tobacco material between about 55% and about 75% by weight, aerosol-former between about 15% and about 25% by weight, and water between about 10% and about 20% by weight.

10. The sachet according to claim 1, wherein the aerosol-forming substrate further comprises a flavourant between about 0.1% and about 10% by weight.

11. An electrically heated aerosol-generating system, comprising:

a sachet of aerosol-forming substrate according to claim 1; and an aerosol-generating device, comprising:

an outer housing having a cavity configured to receive the sachet, and an electrical heater comprising at least one heating element configured to heat the sachet in the cavity and to generate an aerosol.

12. The electrically heated aerosol-generating system according to claim 11, wherein the electrical heater is disposed adjacent at least one wall of the cavity.

13. The electrically heated aerosol-generating system according to claim 11, further comprising:

a power supply configured to supply power to the electrical heater;

electrical hardware connected to the power supply and the electrical heater; and a controller configured to control the supply of electrical power from the power supply to the electrical heater.

14. The electrically heated aerosol-generating system according to claim 13, further comprising a detector configured to detect a presence of the sachet in the cavity and to distinguish the sachet from other sachets configured for the system.

15. The electrically heated aerosol-generating system according to claim 14, wherein the electrical hardware is arranged to establish a heating protocol for the electrical heater based on a particular sachet identified by the detector.

* * * * *